US009096915B2

(12) United States Patent
Ito

(10) Patent No.: US 9,096,915 B2
(45) Date of Patent: Aug. 4, 2015

(54) METHOD OF PRODUCTION OF ALUMINUM ALLOY

(75) Inventor: Hisakazu Ito, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 180 days.

(21) Appl. No.: 13/143,432

(22) PCT Filed: Dec. 10, 2009

(86) PCT No.: PCT/JP2009/071006

§ 371 (c)(1),
(2), (4) Date: Jul. 6, 2011

(87) PCT Pub. No.: WO2010/079677

PCT Pub. Date: Jul. 15, 2010

(65) Prior Publication Data

US 2011/0265606 A1 Nov. 3, 2011

(30) Foreign Application Priority Data

Jan. 6, 2009 (JP) ..... 2009-001016

(51) Int. Cl.
*C22C 1/02* (2006.01)
*B22D 11/00* (2006.01)
(Continued)

(52) U.S. Cl.
CPC ..... *C22C 1/026* (2013.01); *B22D 11/003* (2013.01); *C22C 21/00* (2013.01); *C22C 21/06* (2013.01); *C22C 21/08* (2013.01); *C22C 24/00* (2013.01)

(58) Field of Classification Search
CPC ..... B22D 11/003; C22C 1/026; C22C 24/00; C22C 21/06; C22C 21/08; C22C 21/00
USPC ..... 75/414; 420/528
See application file for complete search history.

(56) References Cited

U.S. PATENT DOCUMENTS 3,567,429 A 3/1971 Dunkel et al.
3,926,690 A 12/1975 Morris et al.
(Continued)

FOREIGN PATENT DOCUMENTS

EP 1 069 195 A2 1/2001
EP 1 413 636 A1 4/2004
(Continued)

OTHER PUBLICATIONS

Machine translation of JP 2004083988, 2004.*
(Continued)

*Primary Examiner* — Rebecca Lee
(74) *Attorney, Agent, or Firm* — Millen, White, Zelano & Branigan, P.C.

(57) ABSTRACT

A method of production of an aluminum alloy inhibiting oxidation loss of the alloy melt without the use of Be which is liable to affect the human health.

When preparing an aluminum alloy melt containing Mg, the method adds to the alloy, Ca, Sr, and/or Ba in a composition ratio within a range enclosed by lines connecting four points illustrated in FIG. 1 of a point A (Ca: 18 at %, Sr: 0 at %, and Ba: 82 at %), point B (Ca: 14 at %, Sr: 34 at %, and Ba: 52 at %), point C (Ca: 33.8 at %, Sr: 66.2 at %, and Ba: 0 at %), point D (Ca: 100 at %, Sr: 0 at %, and Ba: 0 at %) and excluding point D so as to adjust the Ca, Sr, and Ba components in the melt to include Ca: 0.001 to 0.5 mass % and one or both of Sr: 0.01 to 2.8 mass % and Ba: 0.01 to 7.83 mass %.

9 Claims, 2 Drawing Sheets

(51) Int. Cl.

| | |
|---|---|
| ***C22C 21/00*** | (2006.01) |
| ***C22C 21/06*** | (2006.01) |
| ***C22C 21/08*** | (2006.01) |
| ***C22C 24/00*** | (2006.01) |

(56) References Cited

U.S. PATENT DOCUMENTS

| | | | | |
|---|---|---|---|---|
| 4,631,172 | A | 12/1986 | Yamamoto et al. | |
| 5,469,911 | A | 11/1995 | Parker | |
| 6,334,978 | B1 | 1/2002 | DeYoung et al. | |
| 2003/0164207 | A1* | 9/2003 | Kashiwazaki et al. | 148/440 |
| 2005/0103159 | A1* | 5/2005 | Ducrocq | 75/385 |
| 2007/0062669 | A1 | 3/2007 | Song et al. | |
| 2009/0288796 | A1 | 11/2009 | Song et al. | |

FOREIGN PATENT DOCUMENTS

| | | | | | |
|---|---|---|---|---|---|
| EP | 1715067 | A1 | * | 10/2006 | B22D 11/00 |
| EP | 1 767 292 | A2 | | 3/2007 | |
| GB | 1 510 915 | A | | 5/1978 | |
| JP | 10-298688 | A | | 11/1998 | |
| JP | 2000-54047 | A | | 2/2000 | |
| JP | 2003286552 | A | * | 10/2003 | C22F 1/05 |
| JP | 2004083988 | A | * | 3/2004 | C22C 21/04 |
| JP | 2004-162101 | A | | 6/2004 | |
| RU | 2 092 604 | C1 | | 10/1997 | |
| SU | 778 314 | A1 | | 4/1996 | |
| WO | WO 95/27578 | A1 | | 10/1995 | |

OTHER PUBLICATIONS

International Search Report of PCT/JP2009/071006 (May 27, 2010).
International Preliminary Report on Patentability of PCT/JP2009/071006 (Apr. 28, 2011).

* cited by examiner

METHOD OF PRODUCTION OF ALUMINUM ALLOY

TECHNICAL FIELD

The present invention relates to a method of production of an aluminum alloy inhibiting oxidation loss.

BACKGROUND ART

In the past, in the process of producing an alloy containing Mg, the general practice had been to add Be.

Be, when added in a small amount, enables inhibition of oxidation loss of the Mg-containing alloy melt and has frequently been used to prevent burning of highly reactive Mg alloy melts and various other alloy melts containing Mg.

However, the problem of health effects has been pointed out for Be. Recently, means for avoiding its use have been searched for.

On the other hand, the method of adding Ca as an alternative to Be addition and cover flux is known (Muromachi, Shigeo and Minegishi, Tomohiro, "Effect of Ca on Al—Mg Alloys", *KEIKINZOKU*, vol. 10, no. 6, (1960): pp. 25 to 28).

Further, in Japanese Patent Publication (A) No. 2001-64743, addition of Sr has been demonstrated to have an effect that reduces surface oxidation on a slab. However, it is unclear as to whether there is an effect in inhibiting oxidation loss when in a high temperature melted state.

That is, in practice, only Ca has been demonstrated to be an alternative to Be.

SUMMARY OF THE INVENTION

The present invention has as its object to provide a method of production of an aluminum alloy inhibiting oxidation loss of the alloy melt without the use of Be which is liable to affect the human health.

The method of production of the aluminum alloy of the present invention, to achieve the object, applies a method of treatment of an aluminum alloy melt containing Mg characterized by adding to the alloy, Ca, Sr, and/or Ba in a composition ratio within a range enclosed by lines connecting the four points illustrated in FIG. 1 of the point A (Ca: 18 at %, Sr: 0 at %, and Ba: 82 at %), point B (Ca: 14 at %, Sr: 34 at %, and Ba: 52 at %), point C (Ca: 33.8 at %, Sr: 66.2 at %, and Ba: 0 at %), point D (Ca: 100 at %, Sr: 0 at %, and Ba: 0 at %) and excluding the point D so as to adjust the Ca, Sr, and Ba components in the melt to include Ca: 0.001 to 0.5 mass % and one or both of Sr: 0.01 to 2.8 mass % and Ba: 0.01 to 7.83 mass %.

As a method of adjusting the Mg content, the Ca, Sr, and/or Ba components may be added to the aluminum alloy melt containing the predetermined Mg, but preferably the Ca, Sr, and/or Ba components are added to adjust the Ca, Sr, and/or Ba components in the melt, then the Mg component is additionally charged into the melt to adjust it to a predetermined Mg content.

The method of production of an aluminum alloy of the present invention is applied to the production of, for example, a wrought material aluminum alloy containing Mg: 0.5 to 6.0 mass %, Si: 0.1 to 0.5 mass %, Fe: 0.7 mass % or less, Cu: 0.04 to 0.2 mass %, and Mn: 0.1 to 1.0 mass %.

Further, it is also applied to the production of, for example, casting aluminum alloy containing Mg: 0.5 to 11.0 mass %, Si: 0.1 to 24.0 mass %, Fe: 0.1 to 1.8 mass %, Cu: 0.1 to 4.5 mass %, and Mn: 0.15 to 0.6 mass %.

Further, it is also applied to the production of, as a specific example, die-casting aluminum alloy containing Mg: 0.5 to 10.5 mass %, Si: 0.1 to 18.0 mass %, Fe: 0.5 to 1.8 mass %, Cu: 0.1 to 5.0 mass %, and Mn: 0.1 to 0.6 mass %.

In the method of production of an aluminum alloy of the present invention, an inhibitor of oxidation loss of the melt, a specific ratio of mixture of Ca, Sr, and/or Ba is added or a composite comprising the specific ratio of mixture of Ca, Sr, and/or Ba is used. Therefore, the use of a harmless melt oxidation loss inhibitor in place of Be, which is liable to affect the human health, can greatly reduce the oxidation loss of an alloy melt.

Further, the costs involved in treatment of exhaust gas containing Be, the work for dross removal, etc. can be reduced, so the production cost of an aluminum alloy can be lowered.

BEST MODE FOR CARRYING OUT THE INVENTION

Figure 1:
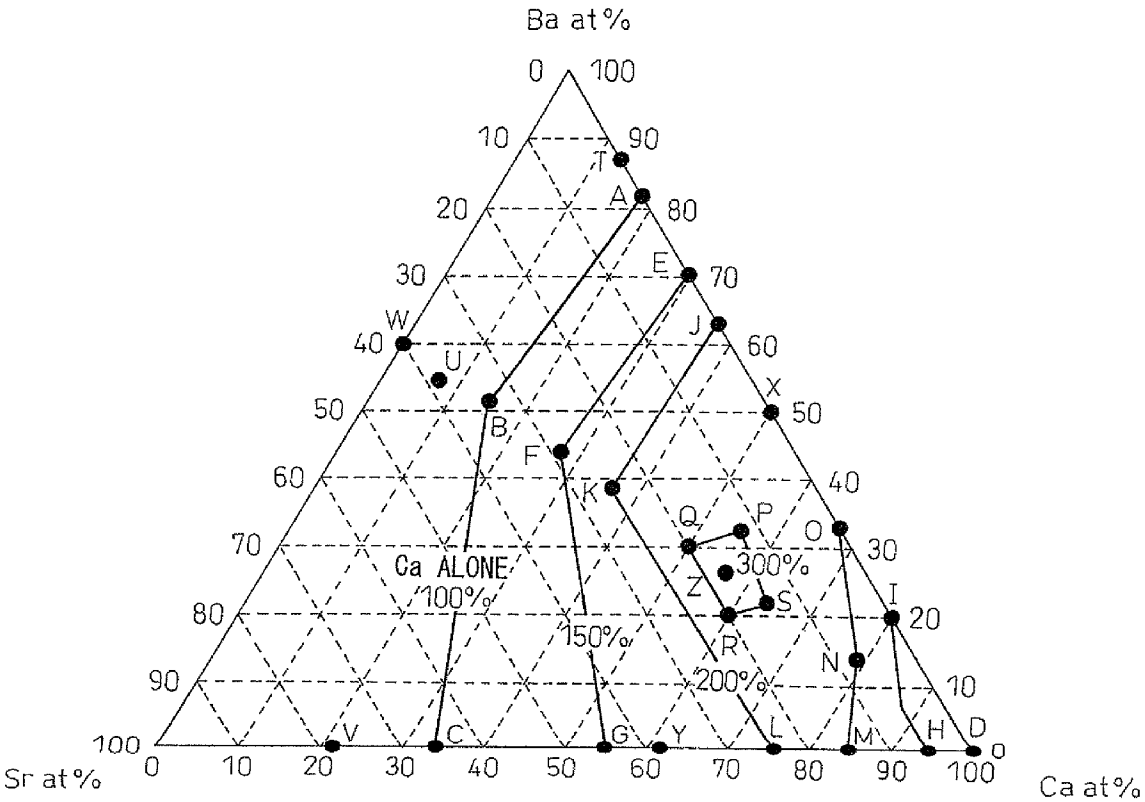
FIG. 1 is a view showing the relationship of Ca, Sr, and Ba with respect to the oxidation resistance.

The inventors carried out intensive studies on measures for inhibiting the oxidation loss of a melt when producing an aluminum alloy containing Mg which replace the use of Be.

In the alloy production process, the alloy melt suffers from oxidation loss in the high temperature state. The degree of progression of oxidation differs for each contained element. The more reactive an element, the faster the progression of oxidation loss.

In aluminum alloys, in particular the 5000 series and other Al—Mg-based alloys are susceptible to progression of oxidation loss by Mg. With Al—Mg-based alloys, the alloy properties are determined by the amount of Mg. Even just a decrease of a small amount of Mg affects the alloy properties, so prevention of Mg loss in the production process is a major industrial issue. In the past, the amount of Mg in the melt had to be constantly measured in order to make up for the amount of decrease of Mg in the melt, but with the present invention it is possible to reduce or eliminate this load. This leads to improvement of the productivity and work efficiency.

In the past, the method of adding Be had been employed as a measure for preventing oxidation loss of an aluminum alloy melt, but due to the problem of the health effect, it is preferable that alloys be free of Be.

As art for replacing Be, addition of the nontoxic Ca is known. However, Ca is known to have, depending on the amount which is added, a number of negative effects on alloy properties such as hot cracking and lowering of mechanical properties and feedability.

Therefore, it was decided to add a combination of Ca, Sr, and/or Ba. Ca, Sr, and Ba are all elements nontoxic to the human health. By composite addition, the effect of inhibition of the oxidation loss is higher than with individual addition of Ca, Sr, or Ba. Further, it is possible to decrease the amount of addition of Ca relatively, so this also decreases the above-mentioned negative effects of Ca.

Below, the present invention will be explained in detail.

The technical advance of composite addition of the present invention exhibits this effect without particular limit so long as added to an aluminum alloy melt containing Mg and may be applied to production of substantially all Al—Mg-based alloys whether for application to wrought material alloys, casting alloys, die-casting alloys, etc.

Note that, the effect of composite addition of Ca, Sr, and Ba is to inhibit the oxidation loss of Mg in the aluminum alloy melt. Therefore, in the process of production of an Al—Mg-based alloy, rather than adding to an aluminum alloy melt containing in advance an Mg content slightly greater than the necessary amount to inhibit the drop in Mg content caused by oxidation loss, it is preferable to add Ca, Sr, and Ba to the alloy melt before adjusting the Mg content, then charge an Mg source to adjust the Mg content.

Further, it is possible to add these in a solid state to an Al—Mg-based alloy ingot adjusted in components in advance, then melt them.

For the rest of the production process, the existing methods of production are followed.

First, a Ca—, Sr—, and Ba-based composite additive will be explained.

As this composite additive, one comprising Ca, Sr, and Ba in a composition ratio within the range enclosed by lines connecting the four points shown in FIG. 1 of the point A (Ca: 18 at %, Sr: 0 at %, and Ba: 82 at %), point B (Ca: 14 at %, Sr: 34 at %, and Ba: 52 at %), point C (Ca: 33.8 at %, Sr: 66.2 at %, and Ba: 0 at %), and point D (Ca: 100 at %, Sr: 0 at %, and Ba: 0 at %) and excluding the D point is used.

When using an additive of a composition ratio outside of the region enclosed by the lines, as explained later, the contents of Ca, Sr, and Ba fall outside predetermined values and the expected effect of inhibition of the oxidation loss is no longer obtained.

If not limiting the amounts of Ca, Sr, and Ba in the aluminum alloy melt after adding the Ca, Sr, and Ba-based composite additive to within predetermined values, the expected effect of inhibition of the oxidation loss is not obtained. The contents of these in the alloy are as follows.

Ca: 0.001 to 0.5 Mass %

An effect of inhibition of the oxidation loss from adding Ca is obtained with a content of 0.001 mass % or more. Accordingly, the lower limit value of the amount of added Ca is 0.001 mass %. However, if the Ca content becomes so large as to exceed 0.5 mass %, negative effects irrespective of use will strongly appear such as hot cracking and lowering of mechanical properties and feedability, so the upper limit value is set as 0.5 mass %.

Sr: 0.01 to 2.8 Mass %

An effect of inhibition of the oxidation loss from adding Sr is obtained with a content of 0.01 mass % or more. Accordingly, the lower limit value of the amount of added Sr is 0.01 mass %. Further, from the viewpoint of its ratio with the amount of added Ca, its upper limit value is set as 2.8 mass %. When an amount of Ca of 0.5 mass % is added alone, the maximum amount of added Sr for improving the effect of inhibition of the oxidation loss is 2.8 mass %. If exceeded, the effect is lower than the effect of inhibition of the oxidation loss when Ca is added alone. Therefore, the upper limit value of Sr is 2.8 mass %.

Ba: 0.01 to 7.83 Mass %

An effect of inhibition of the oxidation loss from adding Ba is obtained with a content of 0.01 mass % or more. Accordingly, the lower limit value of the amount of added Ba is 0.01 mass %. Further, from the viewpoint of its ratio with the amount of added Ca, the upper limit value is set as 7.83 mass %. When an amount of Ca of 0.5 mass % is added alone, the maximum amount of added Ba for improving the effect of inhibition of the oxidation loss is 7.83 mass %. If exceeded, the effect is lower than the effect of inhibition of the oxidation loss when Ca is added alone. Therefore, the upper limit value of Ba is 7.83 mass %.

Next, the aluminum alloy applying the skill of composite addition of the present invention will be explained.

As a specific example of an Al—Mg-based alloy applying the skill of composite addition of the present invention, the invention can be applied to an aluminum alloy comprising Mg: 0.5 mass % or more, Si: 0.1 to 24.0 mass %, Cu: 0.04 to 5.0 mass %, Mn: 0.1 to 2.0 mass %, and other unavoidable elements.

The following elements and their compositions have no effect on the skill of composite addition of the present invention. In other words, the skill of composite addition of the present invention can be applied so long as it is used on an aluminum alloy of a range containing the following elements.

Mg: 0.5 Mass % or More

If the Mg content is less than 0.5 mass %, it will be difficult to obtain the effect of inhibition of the oxidation loss of Mg of the present invention, so the lower limit value is set as 0.5 mass %. Further, a 6.0 mass % will make wrought material alloys susceptible to edge cracking and intergranular corrosion, so 6.0 mass % is set as the upper limit. Further, from the viewpoint of alloy applications, the upper limit is preferably set to 11.0 mass % for casting alloys and 10.5 mass % for die-casting alloys. A content exceeding 11.0 mass % will cause cast cracking and narrow the range of application, so the upper limit value is preferably 11.0 mass %.

Si: 0.1 to 24.0 Mass %

The addition of Si decreases the thermal expansion coefficient and increases the hardness, so improves the wear resistance. However, if Si is excessively added, coarse Si crystals form and the workability drops. Therefore, for this action to be expressed, 0.1 mass % or more should be contained. As the prescribed range of applications, to obtain an alloy composition of a wide range of applications, the upper limit value is preferably set to 6.0 mass % for wrought material alloys, 24.0 mass % for casting alloys, and 18.0 mass % for die-casting alloys.

Cu: 0.04 to 5.0 Mass %

Cu has an action of improving the strength. This action becomes remarkable by a content of 0.04 mass %. However, from the viewpoint of alloy standards, the upper limit value is preferably set to 0.2 mass % for wrought material alloys, 4.5 mass % for casting alloys, and 5.0 mass % for die-casting alloys.

Mn: 0.1 to 2.0 Mass %

Mn has an action of making recrystallized grains finer and improving strength. This action becomes remarkable with a content of 0.1 mass % or more. However, a large content will lower shapeability, so the upper limit value is preferably set to 2.0 mass % for wrought material alloys and 0.6 mass % for casting alloys and die-cast alloys.

As other unavoidable impurities, the contents of Sn, Pb, B, V, and Zr are preferably limited to 0.1 mass % or less.

In this way, the skill of composite addition of the present invention is able to demonstrate its effect irrespective of the alloy being a wrought material alloy, casting alloy, and die-casting alloy so long as it is an aluminum alloy containing Mg of 0.5 mass % or more. Accordingly, it can be applied to methods of production of a wide range of members such as building materials and pressure vessels, drums, electric appliances/parts, engine parts, auto parts, OA equipment, etc.

EXAMPLE 1

Ca, Ba, and Sr were added with each ratio of mixture shown in Table 1 to an Al—Mg-based alloy melt comprised of Si: 0.03 mass %, Fe: 0.05 mass %, Cu: 0.01 mass % or less, Mn: 0.01 mass % or less, Mg: 3.45 mass %, and a balance of Al and unavoidable impurities.

An ingot was prepared from each obtained alloy melt, then the ingot was worked into a test piece of a 6.8 mmϕ×2.7 mm cylindrical test piece of a weight of 270 mg.

Further, each test piece was heated in an atmosphere of a stream of pure air with a dew point of 0° C. and a flow rate of 50 ml/min at a rate of temperature elevation of 30° C./min up to 800° C. At that temperature, the molten state piece was oxidized. The time until the weight increased 2%, that is, 2% of the test piece in the molten state oxidized and the weight increased by 2% (5 mg) as a whole, was measured. This measurement value was made an indicator of the oxidation resistance. For the measurement, a thermogravimetric analysis instrument made by Shimadzu Corporation was used.

Measurement results showing the content ratios (mass %) of Ca, Ba, and Sr and oxidation resistance indicators for the test pieces (A to Z) after variously adjusting the weights and composition ratios of Ca, Ba, and Sr are recorded together in Table 1.

As reference, the time it takes for the weight to increase by 2% (5 mg) overall was measured using the exact same method for a test piece having no oxidation loss inhibitor added at all, a test piece having Be added as an oxidation loss inhibitor, and test pieces having Ba added alone, Sr added alone, and Ca added alone.

The composition and oxidation resistance indicator of each reference test piece are shown in Table 2.

Note that, the Be content of the test piece in which Be was added alone was 0.006 mass %.

Figure 2:
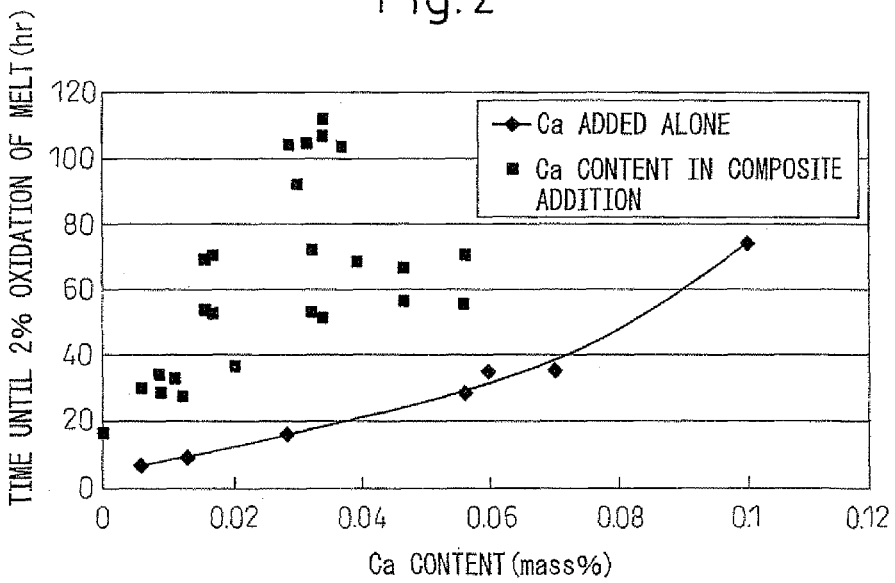
FIG. 2 is a view comparing the addition of Ca alone and composite addition with respect to the oxidation resistance.

The results shown in Table 1 and Table 2, if plotting the oxidation resistance indicator against the Ca content, appear as shown in FIG. 2.

From FIG. 2, it can be understood that in comparison with adding Ca alone, the composite addition of Ca with Sr and/or Ba gives a superior oxidation resistance.

In this regard, as explained above, cases of adding Ca with the object of preventing oxidation loss of the alloy melt are well known, but Ca has a number of effects depending on the amount of it added such as hot cracking and lowering of mechanical properties and melt properties. Therefore, the maximum amount of Ca that can be added is variously set according to the alloy application.

The results shown in FIG. 2 indicate that the problem of the limiting the amount of Ca added is solvable. That is, even if the content of Ca in each alloy test piece is the same, composite addition with Ba or Sr gives a much greater effect of inhibition of oxidation loss. For example, when seeking to achieve an effect of inhibition of oxidation loss at the same level as one from an alloy with 0.1 mass % of Ca added alone, use of a composite addition combining Ba and Sr can lower the amount of Ca added to about 0.056 mass %, further, changing the content ratio of Ba and Sr results in a greater effect than the effect of inhibition of oxidation loss obtained from addition of 0.1 mass % of Ca alone.

TABLE 1

Contents (mass %) of Ca, Sr, and Ba and Oxidation Resistance Indicator in Example 1

| Test piece No. | Ca, Sr, and Ba content (mass %) in melt: Ca | Ba | Sr | 2% oxidation increase time (hr) |
|---|---|---|---|---|
| A | 0.011 | 0.167 | 0 | 33.5 |
| B | 0.008 | 0.106 | 0.044 | 34.2 |
| C | 0.020 | 0 | 0.086 | 36.8 |
| D | 0.060 | 0 | 0 | 35 |
| E | 0.017 | 0.147 | 0 | 53.1 |
| F | 0.016 | 0.090 | 0.039 | 54 |
| G | 0.032 | 0 | 0.060 | 53.5 |
| H | 0.056 | 0 | 0.008 | 55.2 |
| I | 0.047 | 0.045 | 0 | 56.4 |
| J | 0.021 | 0.133 | 0 | 69.8 |
| K | 0.021 | 0.080 | 0.034 | 68.8 |
| L | 0.045 | 0 | 0.033 | 72.2 |
| M | 0.049 | 0 | 0.022 | 70.1 |
| N | 0.046 | 0.027 | 0.012 | 66.6 |
| O | 0.039 | 0.069 | 0 | 68.2 |
| P | 0.032 | 0.069 | 0.017 | 104.3 |
| Q | 0.029 | 0.063 | 0.027 | 103.7 |
| R | 0.034 | 0.045 | 0.029 | 106.1 |
| S | 0.037 | 0.047 | 0.020 | 103.3 |
| T | 0.009 | 0.173 | 0 | 28.7 |
| U | 0.006 | 0.112 | 0.049 | 29.9 |
| V | 0.012 | 0 | 0.104 | 27.7 |
| W | 0 | 0.11 | 0.048 | 17.2 |
| X | 0.03 | 0.11 | 0 | 91.9 |
| Y | 0.034 | 0 | 0.05 | 51.3 |
| Z | 0.034 | 0.06 | 0.027 | 111.6 |

TABLE 2

Contents of Ca, Sr, and Ba and Oxidation Resistance Indicator in Reference Examples

| Test piece No. | Ca, Sr, and Ba content (mass %) in melt: Ca | Ba | Sr | 2% oxidation increase time (hr) |
|---|---|---|---|---|
| None added | 0 | 0 | 0 | 1.0 |
| Be added alone | 0 | 0 | 0 | 130.0 |
| Ba added alone (1) | 0 | 0.27 | 0 | 12 |
| Ba added alone (2) | 0 | 0.42 | 0 | 32.2 |
| Sr added alone (1) | 0 | 0 | 0.14 | 25 |
| Sr added alone (2) | 0 | 0 | 0.27 | 49.4 |
| Ca added alone (1) | 0.0056 | 0 | 0 | 6.2 |
| Ca added alone (2) | 0.013 | 0 | 0 | 9.7 |
| Ca added alone (3) | 0.028 | 0 | 0 | 16.3 |
| Ca added alone (4) | 0.056 | 0 | 0 | 28.8 |
| Ca added alone (5) | 0.07 | 0 | 0 | 35.4 |
| Ca added alone (6) | 0.1 | 0 | 0 | 74.1 |

For confirmation of the usefulness of composite addition of Ca with Sr and/or Ba, Table 3 shows the relationship of the composite addition of Ca with Sr and/or Ba and the oxidation resistance indicator when expressed by the addition ratios (at %) of Ca with Sr and/or Ba shown in Table 1. Note that, the contents of Ca, Ba, and Sr in the alloy melt are indicated by <mass %>, and the composition ratios of only Ca, Ba, and Sr in the added elements and alloy melts are shown by <at %>.

Further, if showing the time it takes for 2% of the weight of a test piece to oxidize is shown relatively based on Table 3, it appears as shown in FIG. 1. That is, if plotting the test pieces A to Z shown in Table 1 on a triangle graph representing the composition ratios of Ca, Sr, and Ba by the atomic number ratios and indexing the time it takes for 2% of the weight of a test piece to oxidize to the time it takes for 2% of the weight of a test piece to oxide obtained by addition of Ca alone, connecting the points giving the same level, the 150% level, the 200% level, and the 300% level of the effect of inhibition of the oxidation loss results in FIG. 1.

TABLE 3

Addition Ratio (at %) of Ca, Sr, and Ba and Oxidation Resistance Indicator in Example 1

| Test piece | Addition ratio (at %) of Ca, Sr, and Ba | | | 2% oxidation increase |
|---|---|---|---|---|
| No. | Ca | Ba | Sr | time (hr) |
| A | 18 | 82 | 0 | 33.5 |
| B | 14 | 52 | 34 | 34.2 |
| C | 33.8 | 0 | 66.2 | 36.8 |
| D | 100 | 0 | 0 | 35 |
| E | 28 | 72 | 0 | 53.1 |
| F | 26 | 44 | 30 | 54 |
| G | 54 | 0 | 46 | 53.5 |
| H | 94 | 0 | 6 | 55.2 |
| I | 78 | 22 | 0 | 56.4 |
| J | 35 | 65 | 0 | 69.8 |
| K | 35 | 39 | 26 | 68.8 |
| L | 75 | 0 | 25 | 72.2 |
| M | 83 | 0 | 17 | 70.1 |
| N | 78 | 13 | 9 | 66.6 |
| O | 66 | 34 | 0 | 68.2 |
| P | 53 | 34 | 13 | 104.3 |
| Q | 48 | 31 | 21 | 103.7 |
| R | 56 | 22 | 22 | 106.1 |
| S | 62 | 23 | 15 | 103.3 |
| T | 16 | 84 | 0 | 28.7 |
| U | 9 | 54.6 | 36.4 | 29.9 |
| V | 21 | 0 | 79 | 27.7 |
| W | 0 | 59.5 | 40.5 | 17.2 |
| X | 50 | 50 | 0 | 91.9 |
| Y | 59.8 | 0 | 40.2 | 51.3 |
| Z | 53.3 | 27.4 | 19.3 | 111.6 |

From Table 2, it is learned that a large effect of inhibition of oxidation loss cannot be obtained with addition of Sr alone or addition of Ba alone. The present invention is characterized by a composite addition ratio that give an effect of inhibition of oxidation loss greater than that obtained by addition of Ca alone.

Further, the D point of FIG. 1 shows a case where Ca is added alone. Seen from the effects shown in Table 3, if making the effect of inhibition of oxidation loss obtained from adding Ca alone 100%, the pattern of composite addition exhibiting an equivalent effect of inhibition of oxidation loss is shown by the lines connecting points A, B, C, and D of FIG. 1, while the pattern of composite addition exhibiting an effect of inhibition of oxidation loss higher than when adding Ca alone is shown by the inside of the lines connecting the points A, B, C, and D.

As ranges with even greater effect, the region encompassed by the lines connecting points E, F, G, H, and I in FIG. 1 gives a 150% effect, further, a range encompassed within points J, K, L, M, N, and O gives a 200% effect, and a region encompassed by points P, Q, R, and S gives a 300% effect. In this way, changing the composition ratios of the composite addition elements Ca, Sr, and Ba enables a far greater improvement of effect of inhibition of oxidation loss than when adding Ca alone.

The effect of inhibition of oxidation loss is expressed by the indicator of the time it takes for 2% of the weight of a test piece to oxidize. The longer the time, the greater resistance to oxidation and the lower the degree of loss of Mg. The longer the time it takes for 2% oxidation, the less the degree of progression of oxidation per unit time, so the less the amount of loss of the Mg of the produced alloy and the smaller the effect on the alloy properties.

Note that, the present invention relates to a method of production of an aluminum alloy inhibiting oxidation loss using the means of adjusting the Ca, Sr, and Ba contents in the alloy melt to a specific ratio. The content ratio of the three elements Ca, Sr, and/or Ba in the alloy melt is preferably within the range of ABCD of FIG. 1 in particular (when seeking greater effects, it may be any of EFGHI, JKLMNO, and PQRS). The reason is that the Ca, Sr, and Ba of the above composition ratio can give the effects of oxidation resistance at a solid-state alloy surface, so it is thought that it is preferable for the composition ratio in the alloy melt of Ca, Sr, and Ba not to deviate from the composition ratio in the solid state. Further, when the processed alloy etc. is remelted as a secondary alloy, if Ca, Sr, and Ba are contained in the alloy at a specific ratio, the effect of inhibition of oxidation loss of the alloy melt can be obtained.

EXAMPLE 2

An example of applying the composite addition of the present invention to an Al-1.5% Mg alloy will be introduced.

Ca, Ba, and Sr were added in the ratio of mixture shown in Table 5 to each Al—Mg-based alloy melt shown in Table 4. Each test piece was measured for oxidation weight in exactly the same manner as Example 1. Further, the time it took for a 2% oxidation weight increase to occur was compared in the same way as Example 1. The results are recorded in Table 5.

TABLE 4

Composition of Base Material of Example 2

| Alloy | Composition (mass %) | | | | | | | | | | |
|---|---|---|---|---|---|---|---|---|---|---|---|
| type | Mg | Si | Fe | Cu | Mn | Cr | Zn | Ti | Ni | Sn | Pb |
| 2-(1) | 1.51 | 0.23 | — | 0.03 | 0.20 | — | — | — | — | — | — |
| 2-(2) | 1.5 | 0.25 | — | 0.04 | 0.19 | — | — | — | — | — | — |
| 2-(3) | 1.5 | 10.5 | 1.81 | 1.48 | 0.49 | 0.25 | 1.45 | 0.08 | 1.6 | 0.5 | 0.49 |
| 2-(4) | 1.49 | 9.9 | 1.80 | 1.5 | 0.52 | 0.24 | 1.48 | 0.1 | 1.5 | 0.5 | 0.6 |
| 2-(5) | 1.5 | 21.2 | 1.29 | 4.6 | 1.5 | 0.47 | 7.7 | 0.2 | 2.3 | 0.9 | 1.1 |
| 2-(6) | 1.48 | 22.3 | 1.3 | 4.5 | 1.6 | 0.44 | 7.5 | 0.21 | 2.4 | 1.0 | 1.0 |

TABLE 5

| Amounts of Added Ca, Sr, and Ba (mass %) and Oxidation Resistance Indicator in Example 2 | | | | | |
|---|---|---|---|---|---|
| Alloy | Ca, Sr, and Ba amount in melt (mass %) | | | 2% oxidation increase | |
| type | Ca | Ba | Sr | time (hr) | Remarks |
| 2-(1) | — | — | — | 1.1 | Comparative example |
| 2-(2) | 0.055 | 0.096 | 0.037 | 11.1 | Invention example |
| 2-(3) | — | — | — | 1 | Comparative example |
| 2-(4) | 0.055 | 0.096 | 0.037 | 12.2 | Invention example |
| 2-(5) | — | — | — | 1.3 | Comparative example |
| 2-(6) | 0.055 | 0.096 | 0.037 | 10.5 | Invention example |

EXAMPLE 3

Further, an example of applying the composite addition of the present invention to an Al-5% Mg alloy will be introduced.

Ca, Ba, and Sr were added in the ratio of mixture shown in Table 7 to each Al—Mg-based alloy melt shown in Table 6. Each test piece was measured for oxidation weight in exactly the same manner as Example 1. Further, the time it took for a 2% oxidation weight increase to occur was compared in the same way as Example 1. The results are recorded in Table 7.

TABLE 6

| Composition of Base Material of Example 3 | | | | | | | | | | | |
|---|---|---|---|---|---|---|---|---|---|---|---|
| Alloy | Composition (mass %) | | | | | | | | | | |
| type | Mg | Si | Fe | Cu | Mn | Cr | Zn | Ti | Ni | Sn | Pb |
| 3-(1) | 5.2 | 0.23 | — | 0.04 | 0.2 | — | — | — | — | — | — |
| 3-(2) | 5.1 | 0.22 | — | 0.04 | 0.21 | — | — | — | — | — | — |
| 3-(3) | 5.0 | 10.4 | 1.78 | 1.4 | 0.51 | 0.26 | 1.47 | 0.09 | 1.5 | 0.5 | 0.49 |
| 3-(4) | 5.1 | 10.5 | 1.81 | 1.5 | 0.49 | 0.25 | 1.5 | 0.1 | 1.48 | 0.4 | 0.5 |
| 3-(5) | 4.9 | 23 | 1.28 | 4.3 | 1.4 | 0.49 | 7.7 | 0.19 | 2.2 | 0.09 | 1.0 |
| 3-(6) | 4.9 | 22.5 | 1.3 | 4.2 | 1.5 | 0.5 | 7.6 | 0.18 | 2.3 | 0.09 | 1.0 |

TABLE 7

| Amounts of Added Ca, Sr, and Ba (mass %) and Oxidation Resistance Indicator in Example 3 | | | | | |
|---|---|---|---|---|---|
| Alloy | Ca, Sr, and Ba amount in melt (mass %) | | | 2% oxidation increase | |
| type | Ca | Ba | Sr | time (hr) | Remarks |
| 3-(1) | — | — | — | 1.1 | Comparative example |
| 3-(2) | 0.055 | 0.096 | 0.037 | 12.4 | Invention example |
| 3-(3) | — | — | — | 0.9 | Comparative example |
| 3-(4) | 0.055 | 0.096 | 0.037 | 11.4 | Invention example |
| 3-(5) | — | — | — | 1 | Comparative example |
| 3-(6) | 0.055 | 0.096 | 0.037 | 11.2 | Invention example |

EXAMPLE 4

Further, an example of applying the composite addition of the present invention to an Al-10% Mg alloy will be introduced.

Ca, Ba, and Sr were added in the ratio of mixture shown in Table 9 to each Al—Mg-based alloy melt shown in Table 8. Each test piece was measured for oxidation weight in exactly the same manner as Example 1. Further, the time it took for a 2% oxidation weight increase to occur was compared in the same way as Example 1. The results are recorded in Table 9.

TABLE 8

| Composition of Base Material of Example 4 | | | | | | | | | | | |
|---|---|---|---|---|---|---|---|---|---|---|---|
| Alloy | Composition (mass %) | | | | | | | | | | |
| type | Mg | Si | Fe | Cu | Mn | Cr | Zn | Ti | Ni | Sn | Pb |
| 4-(1) | 10.1 | 0.24 | — | 0.03 | 0.2 | — | — | — | — | — | — |
| 4-(2) | 9.8 | 0.25 | — | 0.04 | 0.18 | — | — | — | — | — | — |
| 4-(3) | 9.8 | 10.3 | 1.8 | 1.5 | 0.5 | 0.24 | 1.4 | 0.1 | 1.5 | 0.5 | 0.52 |
| 4-(4) | 10.2 | 10.4 | 1.6 | 1.48 | 0.49 | 0.25 | 1.5 | 0.09 | 1.4 | 0.49 | 0.5 |
| 4-(5) | 10.0 | 22 | 1.25 | 4.5 | 1.5 | 0.47 | 7.6 | 0.19 | 2.2 | 1.0 | 0.9 |
| 4-(6) | 10.0 | 22.2 | 1.3 | 4.4 | 1.48 | 0.45 | 7.4 | 0.2 | 2.2 | 1.1 | 1.0 |

TABLE 9

| Amounts of Added Ca, Sr, and Ba (mass %) and Oxidation Resistance Indicator in Example 4 | | | | | |
|---|---|---|---|---|---|
| Alloy | Ca, Sr, and Ba amount in melt (mass %) | | | 2% oxidation increase | |
| type | Ca | Ba | Sr | time (hr) | Remarks |
| 4-(1) | — | — | — | 0.7 | Comparative example |
| 4-(2) | 0.055 | 0.096 | 0.037 | 8.1 | Invention example |
| 4-(3) | — | — | — | 0.8 | Comparative example |
| 4-(4) | 0.055 | 0.096 | 0.037 | 9.4 | Invention example |
| 4-(5) | — | — | — | 0.7 | Comparative example |
| 4-(6) | 0.055 | 0.096 | 0.037 | 8.2 | Invention example |

EXAMPLE 5

Finally, an example of application of the composite addition of the present invention to a JIS alloy is presented. The composite elements were added to the wrought material alloy 5083, casting alloy AC7A, and die-casting alloy ADC5 having the compositions shown in Table 10 as typical test pieces of aluminum alloys containing large amounts of Mg. The amounts of Ca, Sr, and Ba were adjusted as shown in Table 11, then the time it took for a 2% oxidation weight increase to occur was compared in the same way as Example 1. The results are shown in Table 11.

TABLE 10

| Composition of Base Material of Example 5 | | | | | | | | | | | |
|---|---|---|---|---|---|---|---|---|---|---|---|
| Alloy | Composition (mass %) | | | | | | | | | | |
| type | Mg | Si | Fe | Cu | Mn | Cr | Zn | Ti | Ni | Sn | Pb |
| 5-(1) | 4.9 | 0.40 | 0.41 | 0.11 | 1.00 | 0.24 | 0.26 | 0.14 | — | — | — |
| 5-(2) | 4.9 | 0.41 | 0.42 | 0.11 | 1.03 | 0.24 | 0.26 | 0.14 | — | — | — |
| 5-(3) | 5.52 | 0.21 | 0.30 | 0.10 | 0.58 | 0.14 | 0.18 | 0.16 | 0.05 | 0.06 | 0.06 |
| 5-(4) | 5.50 | 0.21 | 0.30 | 0.10 | 0.59 | 0.14 | 0.17 | 0.17 | 0.05 | 0.06 | 0.07 |
| 5-(5) | 8.50 | 0.3 | 1.80 | 0.2 | 0.29 | — | 0.10 | 0.13 | 0.10 | 0.10 | 0.10 |
| 5-(6) | 8.50 | 0.3 | 1.80 | 0.2 | 0.30 | — | 0.11 | 0.13 | 0.10 | 0.11 | 0.11 |

TABLE 11

| Amounts of Added Ca, Sr, and Ba (mass %) and Oxidation Resistance Indicator in Example 5 | | | | | |
|---|---|---|---|---|---|
| Alloy | Ca, Sr, and Ba amount in melt (mass %) | | | 2% oxidation increase | |
| type | Ca | Ba | Sr | time (hr) | Remarks |
| 5-(1) | — | — | — | 1.1 | Comparative example |
| 5-(2) | 0.043 | 0.088 | 0.035 | 12.1 | Invention example |
| 5-(3) | — | — | — | 1.1 | Comparative example |
| 5-(4) | 0.055 | 0.096 | 0.037 | 12.1 | Invention example |
| 5-(5) | — | — | — | 0.6 | Comparative example |
| 5-(6) | 0.083 | 0.108 | 0.060 | 8.4 | Invention example |

According to the results shown in Tables 5, 7, 9, and 11, the test pieces obtained by composite addition had a time for a 2% oxidation weight increase to occur about 10 times greater than in a test piece without addition. From this, it is clear that the effect of inhibition of the oxidation loss due to the composite addition of the present invention is exhibited even for alloys with a comparatively large Mg content.

INDUSTRIAL APPLICABILITY

According to the present invention, there is provided a method of production of an aluminum alloy inhibiting oxidation loss of the alloy melt without the use of Be which is liable to affect the human health.

The invention claimed is:

1. A method of production of a wrought material aluminum alloy containing Mg: 0.5 to 6.0 mass %, Si: 0.1 to 0.5 mass %, Fe: 0.7 mass % or less, Cu : 0.04 to 0.2 mass % and Mn: 0.1 to 1.0 mass %, comprising adding to a melt of the alloy, Ca, Sr, and Ba so as to adjust the content of Ca to 0.032 to 0.037 mass %, Sr to 0.017 to 0.029 mass % and Ba to 0.045 to 0.069 mass %, and the composition ratio of Ca, Sr and Ba to within a range enclosed by lines connecting the following points illustrated in FIG. 1 of point P (Ca: 53 atom %, Sr: 13 atom %, Ba: 34 atom %), point Q (Ca: 48 atom %, Sr: 21 atom %, Ba: 31 atom %), point R (Ca: 56 atom %, Sr: 22 atom %, Ba: 22 atom %), and point S (Ca: 62 atom %, Sr: 15 atom %, Ba: 23 atom %), and including said lines, and wherein the aluminum alloy contains no Be.

2. A method of production of a casting aluminum alloy containing Mg: 0.5 to 11.0 mass %, Si: 0.1 to 24.0 mass %, Fe : 0.1 to 0.7 mass %, Cu: 0.1 to 5.0 mass % and Mn: 0.15 to 0.6 mass %, comprising adding to a melt of the alloy, Ca, Sr, and Ba so as to adjust the content of Ca to 0.032 to 0.037 mass %, Sr to 0.017 to 0.029 mass % and Ba to 0.045 to 0.069 mass %, the composition ratio of Ca, Sr and Ba to within a range enclosed by lines connecting the following points illustrated in FIG.1 of point P (Ca: 53 atom %, Sr: 13 atom %, Ba: 34 atom %), point Q (Ca: 48 atom %, Sr: 21 atom %, Ba: 31 atom %), point R (Ca: 56 atom %, Sr: 22 atom %, Ba: 22 atom %), and point S (Ca: 62 atom %, Sr: 15 atom %, Ba: 23 atom %), and including said line, and wherein the aluminum alloy contains no Be.

3. A method of production of a die-casting aluminum alloy containing Mg: 0.5 to 10.5 mass %, Si: 0.1 to 18.0 mass %, Fe: 0.5 to 1.8 mass %, Cu: 0.1 to 5.0 mass % and Mn: 0.1 to 0.6 mass %, comprising adding to a melt of the alloy, Ca, Sr, and Ba so as to adjust the content of Ca to 0.032 to 0.037 mass %, Sr to 0.017 to 0.029 mass % and Ba to 0.045 to 0.069 mass %, the composition ratio of Ca, Sr and Ba to within a range enclosed by lines connecting the following points illustrated in FIG. 1 of point P (Ca: 53 atom %, Sr: 13 atom %, Ba: 34 atom %), point Q (Ca: 48 atom %, Sr: 21 atom %, Ba: 31 atom %), point R (Ca: 56 atom %, Sr: 22 atom %, Ba: 22 atom %), and point S (Ca: 62atom %, Sr: 15 atom %, Ba: 23 atom %), and including said line, and wherein the aluminum alloy contains no Be.

4. A method according to claim 1, further comprising processing said wrought material aluminum alloy into a wrought material aluminum alloy product.

5. A method according to claim 4, wherein the wrought material aluminum alloy product is a building material, pressure vessel, drum, electric appliance or part, engine part, or auto part.

6. A method according to claim 2, further comprising casting said casting material aluminum alloy into a casting material aluminum alloy product.

7. A method according to claim 6, wherein the casting material aluminum alloy product is a building material, pressure vessel, drum, electric appliance or part, engine part, or auto part.

8. A method according to claim 3, further comprising die-casting said die-casting material aluminum alloy into a die-casting material aluminum alloy product.

9. A method according to claim 8, wherein the die-casting material aluminum alloy product is a building material, pressure vessel, drum, electric appliance or part, engine part, or auto part.

* * * * *